United States Patent [19]

Bresson et al.

[11] Patent Number: 4,883,585

[45] Date of Patent: Nov. 28, 1989

[54] ORE FLOTATION AND SULFENYL DITHIOCARBAMATES AS AGENTS FOR USE THEREIN

[75] Inventors: Clarence R. Bresson; Rector P. Louthan, both of Bartlesville, Okla.

[73] Assignee: Phillips Petroleum Company, Bartlesville, Okla.

[21] Appl. No.: 263,438

[22] Filed: Oct. 27, 1988

[51] Int. Cl.[4] ..... B03D 1/02

[52] U.S. Cl. ..... 209/166; 252/61; 558/235

[58] Field of Search ..... 209/166, 167, 901; 252/61; 423/26

[56] References Cited

U.S. PATENT DOCUMENTS

| | | | |
|---|---|---|---|
| 2,621,143 | 12/1952 | Goodhue et al. | 167/22 |
| 2,693,485 | 11/1954 | Gobell | 260/500 |
| 2,862,850 | 12/1958 | Goodhue | 167/46 |
| 2,934,563 | 4/1960 | Himel | 260/543 |
| 3,425,550 | 2/1969 | Bearson et al. | 209/166 |
| 3,464,551 | 9/1969 | Falvey | 209/166 |
| 4,455,262 | 6/1984 | Detienne et al. | 260/502.6 |
| 4,462,898 | 7/1984 | Parlman et al. | 209/166 |
| 4,514,293 | 4/1985 | Bresson et al. | 209/167 |
| 4,521,301 | 6/1985 | Detienne et al. | 209/166 |
| 4,554,068 | 11/1985 | Kimble et al. | 209/167 |
| 4,554,108 | 11/1985 | Kimble et al. | 260/455 |
| 4,594,151 | 6/1986 | Delourne | 209/166 |
| 4,595,538 | 6/1986 | Kimble et al. | 260/502.56 |
| 4,699,711 | 10/1987 | Bergman | 209/166 |
| 4,702,821 | 10/1987 | Bresson et al. | 209/166 |

FOREIGN PATENT DOCUMENTS

| | | | |
|---|---|---|---|
| 50-50202 | 5/1975 | Japan . | |
| 793177 | 6/1980 | South Africa . | |
| 1131085 | 11/1985 | U.S.S.R. | 209/166 |

*Primary Examiner*—Kenneth M. Schor
*Assistant Examiner*—Thomas M. Lithgow
*Attorney, Agent, or Firm*—Laney, Dougherty, Hessin & Beavers

[57] ABSTRACT

A process for the recovery of minerals from an ore or concentrate containing the same wherein the minerals are recovered in a froth from an aqueous pulp containing the ore or concentrate and wherein one or more mineral flotation agents are employed in the aqueous pulp to control the type of mineral in the froth is provided. The mineral flotation agent or agents employed in the process comprise sulfenyl dithiocarbamates characterized by the formula:

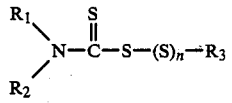

wherein $R_1$ and $R_2$ are selected from the group consisting of hydrogen and hydrocarbyl groups with not more than one of $R_1$ and $R_2$ being hydrogen, n is 1 or 2, and $R_3$ is a hydrocarbyl group.

25 Claims, No Drawings

ORE FLOTATION AND SULFENYL DITHIOCARBAMATES AS AGENTS FOR USE THEREIN

BACKGROUND OF THE INVENTION

1. Field of the Invention

This invention relates generally to ore flotation processes, and more particularly, to ore flotation agents for use in ore flotation processes.

2. Description of the Prior Art

Ore flotation processes for recovering minerals in a froth from an aqueous slurry or pulp containing an ore or a concentrate of the ore are well known. In such processes, the ore is crushed and wet ground to obtain an aqueous slurry or pulp. Additives such as mineral flotation agents known in the art as "collectors" and mineral flotation agents known in the art as "depressants" are admixed with the pulp together with other additives such as frothing agents, stabilizers and the like to assist in separating certain minerals from others. The pulp is then aerated to produce a froth at the surface thereof. Certain minerals contained in the pulp adhere to bubbles of the froth and are carried to the surface of the pulp therewith. Other minerals do not adhere to bubbles of the froth and remain with the tail product or remaining pulp. The minerals adhering to bubbles of the froth are then skimmed or otherwise removed and separated. Both the froth product and the tail product can be further processed to obtain desired minerals. In this way, valuable minerals can be separated from undersired or gangue portions of the ore.

Depressants, also called suppressants, increase the mineral selectivity of the process when admixed with the pulp by reducing the flotation of certain minerals and thereby increasing the production of certain minerals. In other words, depressants selectively inhibit the adherence of certain minerals to the bubbles of the froth thus assisting in the separation of certain minerals from others.

Collectors are added to the pulp to cause certain minerals contained therein to adhere to bubbles of the froth so that they can be recovered when the froth is skimmed or otherwise removed from the pulp. Typical mineral flotation collectors include xanthates, amines, alkyl sulfates, arenes, suflonates, dithiocarbamates, dithiophosphates, thiols, and fuel oils.

Many depressants and collectors have been developed heretofore. It is known in the art that some dithiocarbamates and derivatives thereof are useful as mineral flotation agents. For example, U.S. Pat. No. 3,464,551 discloses that certain dialkyl dithiocarbamates are useful as collectors in froth flotation processes.

By the present invention, it has been discovered that certain sulfenyl dithiocarbamates are very effective as mineral flotation agents in froth flotation processes. Thus, by the present invention, an improved process for the recovery of minerals from an ore or concentrate containing the same is provided.

SUMMARY OF THE INVENTION

By the present invention, a process for recovering minerals from an ore or concentrate containing the same wherein one or more sulfenyl dithiocarbamates are employed as mineral flotation agents is provided. The sulfenyl dithiocarbamates are characterized by the formula:

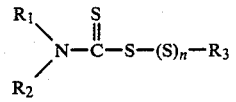

wherein $R_1$ and $R_2$ are each selected from the group consisting of hydrogen and a hydrocarbyl group with not more than one of $R_1$ and $R_2$ being hydrogen, n is 1 or 2 and $R_3$ is a hydrocarbyl group. The phrase "hydrocarbyl group" is used herein to mean any alkyl, alkenyl, cycloalkyl, cycloalkenyl or aryl radical, or any combination of radicals which form groups such as alkaryl, araalkyl, alkenylaryl and the like.

The sulfenyl dithiocarbamates used in carrying out the process of the present invention are particularly effective for use as mineral collectors for separating minerals based on copper, nickel, iron and zinc from the total ore. It is believed that the sulfenyl dithiocarbamates are equally effective for use as mineral collectors for silver and gold.

It is therefore an object of the present invention to provide an improved process for recovering minerals from an ore or concentrate containing the same.

It is an object of the present invention to provide mineral flotation agents for use in froth flotation processes that improve the overall productivity of the processes, Other objects, features, uses and advantages of the present invention will be readily apparent to those skilled in the art upon a reading of the following description of the preferred embodiments of the invention.

DESCRIPTION OF THE PREFERRED EMBODIMENTS

In accordance with the present invention, a process for recovering minerals is provided. More specifically, a process for recovering minerals from an ore or concentrate containing the same wherein the minerals are recovered in a froth from an aqueous slurry or pulp containing the ore or concentrate and wherein one or more new mineral flotation agents are employed in the slurry or pulp to control the type of minerals in the froth is provided.

By employing one or more new mineral flotation agents, the process of the present invention achieves a level of producitvity and other advantages not achieved by other froth flotation processes. Except for the new mineral flotation agent or agents employed, the froth flotation process of the present invention is similar to other froth flotation processes.

The new mineral flotation agents used in carrying out the process of the present invention are sulfenyl dithiocarbamates characterized by the general formula:

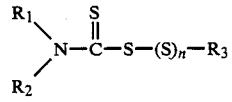

wherein:

$R_1$ and $R_2$ are each selected from the group consisting of hydrogen and hydrocarbyl groups with not more than one of $R_1$ and $R_2$ being hydrogen;

n is 1 or 2; and $R_3$ is a hydrocarbyl group.

As stated above, the phrase "hydrocarbyl group" is used herein to mean any alkyl, alkenyl, cycloalkyl, cycloalkenyl or aryl radical, or any combination of radicals which form groups such as alkaryl, araalkyl, alkenylaryl and the like.

Preferably, $R_1$ and $R_2$ of the above general formula are each selected from the group consisting of hydrogen and alkyl, alkenyl, cycloalkyl and cycloalkenyl radicals, and combinations of alkyl, alkenyl, cycloalkyl or cycloalkenyl radicals with aryl radicals wherein the alkyl, alkenyl, cycloalkyl or cycloalkenyl group of the combination is attached to the nitrogen atom, with not more than one of $R_1$ and $R_2$ being hydrogen. More perferably, $R_1$ and $R_2$ are each selected from the group consisting of hydrogen and alkyl, alkenyl, cycloalkyl and cycloalkenyl radicals having in the range of from 1 to 12 carbon atoms with not more than 1 of $R_1$ and $R_2$ being hydrogen. Most preferably, $R_1$ and $R_2$ are selected from the group consisting of hydrogen and alkyl and alkenyl radicals having in the range of from 1 to 6 carbon atoms with not more than one of $R_1$ and $R_2$ being hydrogen.

Preferably, $R_3$ of the above general formula is a hydrocarbyl group having in the range of from 1 to 8 carbon atoms. More preferably, $R_3$ is a hydrocarbyl group having in the range of from 1 to 5 carbon atoms. Preferably, n of the above general fromula is 1.

One or combinations of two or more of sulfenyl dithiocarbamates characterized by the above general formula can be employed. Combinations of one or more of the sulfenyl dithiocarbamates with other additives such as other mineral flotation agents can also be employed.

Examples of sulfenyl dithiocarbamates that can be used in carrying out the process of the present invention include:

N-methyl-S-methylsulfenyl dithiocarbamate;
N-ethyl-S-methylsulfenyl dithiocarbamate;
N-propyl-S-ethylsulfenyl dithiocarbamate;
N-ethyl-S-isopropylsulfenyl dithiocarbamate;
N-butyl-S-hexylsulfenyl dithiocarbamate;
N-allyl-S-allylsulfenyl dithiocarbamate;
N-hexyl-S-cyclohexylsulfenyl dithiocarbamate;
N-methyl-S-phenylsulfenyl dithiocarbamate;
N,N-dimethyl-S-ethylsulfenyl dithiocarbamate;
N,N-diemthyl-S-isopropylsulfenyl dithiocarbamate;
N,N-diethyl-S-benzylsulfenyl dithiocarbamate; and
N,N-diallyl-S-isopropylsulfenyl dithiocarbamate.

The preferred sulfenyl dithiocarbamates within the group of sulfenyl dithiocarbamates listed above for use in carrying out the process of the present invention are N,N-dimethyl-S-isopropylsulfenyl dithiocarbamate and N-ethyl-S-isopropylsulfenyl dithiocarbamate. N-ethyl-S-isopropylsulfenyl dithiocarbamate is most preferred at the present time.

The sulfenyl dithiocarbamates used in carrying out the process of the present invention can be produced in a variety of ways. For example, the sulfenyl dithiocarbamates can be produced by reacting sulfenyl halides, e.g., alkyl sulfenyl chloride, with salts of N-substituted dithiocarbamic acid. This type of synthesis is described in U.S. Pat. No. 2,621,143, which is incorporated by reference herein.

The froth flotation process of the present invention comprises the steps of crushing ore that contains the minerals to be recovered, mixing the crushed ore, water and at least one sulfenyl dithiocarbamate to establish a pulp, aerating the thus established pulp to produce a froth at the surface of the pulp which is rich in certain minerals but depleted of other minerals or the gangue portions of the ore or vice-versa, and recovering minerals from either the thus produced froth or the tail product. If desired, the sulfenyl dithiocarbamate(s) can be admixed with the ore before it is crushed or with the pulp after the pulp is established but before it is aerated. Of course, as will be understood by those skilled in the art, many additional flotation and frothing steps can be utilized to ultimately obtain the mineral values desired. A variety of flotation agents and processing aids such as flocculants, dispersants, promoters and the like can be used in conjunction with the sulfenyl dithiocarbamates used in the process of the present invention.

The amount of the sulfenyl dithiocarbamate(s) employed in the process of the present invention is not critical. The quantity of the sulfenyl dithiocarbamate(s) employed will depend upon whether the compound or compounds are being used with an ore or a concentrate containing the ore and upon whether there is a large or small amount of the minerals to be affected thereby. The sulfenyl dithiocarbamates used in the process of the present invention should be employed at concentration levels sufficient to provide the desired action on certain minerals.

Generally, the amount of the sulfenyl dithiocarbamate(s) employed in carrying out the process of the present invention will range from about 0.005 pounds to about 5 pounds of the sulfenyl dithiocarbamate(s) per ton of solids or crushed ore (lb./ton) in the pulp. Preferably, the amount of the sulfenyl dithiocarbamates employed is in the range of from about 0.01 pounds to about 0.5 pounds per ton of solids or crushed ore (lb./ton) in the pulp.

As discussed above, the sulfenyl dithiocarbamate mineral flotation agents used in the process of the present invention can be admixed with the ore during the ore grinding stage of the process, can be admixed with the crushed ore and water used to establish the pulp or with the pulp during the ore flotation stage of the process, or can be admixed with the concentrate which is to be further processed. Preferably, the agent(s) are admixed with the crushed ore and water used to establish the pulp during the ore flotation stage of the process.

It is generally believed that the sulfenyl dithiocarbamate mineral flotation agents used in the process of the present invention are useful for separating any mineral from other minerals or gangue portions of the ore. The agents can be used to separate a mixture of metals contained in a particular mining déposit or ore, the mixture being further separated by subsequent froth flotations or other conventional separating procedures. The sulfenyl dithiocarbamates are very useful as metal sulfide mineral collectors. They are particularly useful as metal sulfide mineral collectors for separating minerals based on copper, nickle, iron and zinc from the total ore. It is thought that they are equally useful as mineral collectors for silver and gold.

Any froth flotation apparatus can be used for carrying out the process of the present invention. Commonly used commercial flotation machines are the Agitar (Galigher Company), Denver Sub-A (Denver Equipment Company) and the Fagergren (Western Machinery Company).

The above-described sulfenyl dithiocarbamate mineral flotation agents have been used effectively in froth flotation processes conducted at temperatures in the range of from about 40° F. to about 100° F. and under atmospheric pressure. However, any temperature and pressure generally employed by those skilled in the art is within the scope of this invention.

The following examples are provided to further illustrate the effectiveness of the above-described sulfenyl dithiocarbamates as mineral flotation agents in froth flotation processes.

EXAMPLE I

This example illustrates the effectiveness of sulfenyl dithiocarbamates as collectors for copper, nickel and iron in ore flotation processes. The effectiveness of the sulfenyl dithiocarbamates is compared to the effectiveness of other compounds known to be useful as collectors in ore flotation processes.

The sulfenyl dithiocarbamates tested were:

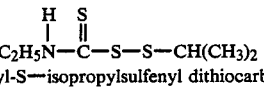

N—ethyl-S—isopropylsulfenyl dithiocarbamate;

and

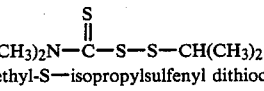

N,N—dimethyl-S—isopropylsulfenyl dithiocarbamate.

The other collectors tested were:

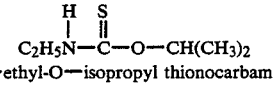

N—ethyl-O—isopropyl thionocarbamate;

and

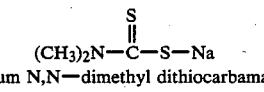

Sodium N,N—dimethyl dithiocarbamate.

A charge of 750 grams of an ore containing copper, nickel and iron, 300 milliliters of tap water, and 0.65 gram (1.73 pounds/ton) of lime was placed in a ball mill and the mixture was ground for two minutes and 55 seconds. The resulting slurry was transferred to a 2.5 liter capacity Denver D-12 flotation cell along with enough water to make about a 30 weight percent aqueous slurry. Also added to the cell were 3 drops (0.034 pounds/ton) of a frother (Dowfroth 250), 0.35 milliliter (0.008 pounds/ton) of a 1 weight percent aqueous solution of a first collector, sodium isopropyl xanthate, and 22 drops (0.15 pounds/ton) of a second collector, the N-ethyl-S-isopropylsulfenyl dithiocarbamate. The slurry was conditioned for 1 minute at 1100 rpm. After conditioning, the slurry was floated for 7 minutes and the concentrate was filtered, dired and analyzed. The procedure was repeated and average weight percent recoveries of copper, nickel and iron were calculated from the two runs.

The procedure was then repeated for the N,N-dimethyl-S-isopropylsulfenyl dithiocarbamate and the other collectors. In each run, the procedure was the same as the procedure described above except the second collector, the N-ethyl-S-isopropylsulfenyl dithiocarbamate, was replaced by the N,N-diemthyl-S-isopropylsulfenyl dithiocarbamate or other collector being tested. Each collector was tested twice and average weight pecent recoveries for copper, nickel and iron were calculated from the two runs.

The results of the tests are shown in Table I below.

TABLE I

Sulfenyl Dithiocarbamates as Collectors for Copper, Nickel and Iron in Ore Flotation

| Test No. | Second Collector, 0.15 lbs/ton | Wt. % Recovery* Cu | Ni | Fe |
|---|---|---|---|---|
| 1 | N—ethyl-S—isopropylsulfenyl dithiocarbamate | 81.31 | 32.94 | 14.99 |
| 2 | N,N—dimethyl-S—isopropylsulfenyl dithiocarbamate | 76.70 | 34.87 | 16.29 |
| 3 | N—ethyl-O—isopropyl thionocarbamate | 75.30 | 20.95 | 10.58 |
| 4 | Sodium, N,N—dimethyl dithiocarbamate | 53.64 | 17.68 | 9.47 |

*The values shown represent average weight percent recoveries based on two runs.

The results of the tests show that the sulfenyl dithiocarbamates used in the process of the present invention are effective collectors for copper, nickel and iron. The sulfenyl dithiocarbamate collectors led to significantly higher average weight percent recoveries of copper, nickel and iron than the other collectors tested.

EXAMPLE II

This example illustrates the effectiveness of N-ethyl-S-isopropylsulfenyl dithiocarbamate as a collector for zinc in an ore flotation process. The effectiveness of the N-ethyl-S-isopropylsulfenyl dithiocarbamate as a collector for zinc is compared to the effectiveness of O-isopropyl N-ethyl thionocarbamate, a known collector for zinc in ore flotation processes.

A charge of 1000 grams of an ore containing lead and zinc, 425 milliliters of tap water, 4 milliliters (0.04 pounds/ton) of an aqueous solution containing 5 percent by weight sodium cyanide (NaCN), 6.4 grams (12.8 pounds/ton) of sodium carbonate ($Na_2CO_3$) and 2.5 milliliters (0.5 pounds/ton) of an aqueous solution containing 16 percent by weight zinc sulfate ($ZnSO_4$) was placed in a ball mill and the mixture was ground for 5 minutes and 42 seconds. The resulting slurry was then transferred to a 4-liter capacity Wemco flotation cell. An amount of water sufficient to make a slurry containing 30 percent by weight solids was added to the cell. Also added to the cell were 5 drops (0.03 pounds/ton) of methyl isobutylcarbonate, a frother, and 7 milliliters (0.07 pounds/ton) of an aqueous solution containing 0.5 percent by weight sodium isopropyl xanthate, a lead collector. The slurry was then conditioned for 30 seconds at 1200 rpm. After conditioning, the slurry was floated for 4 minutes (lead float) and the concentrate was filtered, dried and analyzed.

Next, an amount of lime sufficient to adjust the pH of the remaining slurry in the cell to 10.8 was added to the cell. Also added to the cell were 3 milliliters (0.6 pounds/ton) of an aqueous solution containing 10 percent by weight copper sulfate ($CuSO_4$). After conditioning the slurry for two minutes, 6 drops (0.05 pounds/ton) of a frother (Dowfroth 250) were added to the cell. The slurry was then conditioned for 30 seconds at 1200 rpm. After conditioning, the slurry was floated for 5 minutes (zinc float) and the new concentrate was filtered, dried and analyzed.

The procedure was repeated and average weight pecent recoveries of lead, zinc and iron from both the lead float and the zinc float were calculated from the two runs.

The procedure was then repeated to determine the average weight percent recoveries of lead, zinc and iron achieved when the N-ethyl-S-isopropylsulfenyl dithiocarbamate and O-isopropyl N-ethyl thionocarbamate were employed as collectors. In each test, the N-ethyl-S-isopropylsulfenyl dithiocarbamate or O-isopropyl N-ethyl thionocarbamate was added to the ball mill with the other materials charged thereto before the ore was ground. Three runs were made for each collector and average weight percent recoveries of lead, zinc and iron from both the lead float and the zinc float were calculated from the three runs.

The results of the tests are summarized in Table II below.

TABLE II

N—Ethyl-S—Isopropylsulfenyl Dithiocarbamate as Collector for Zinc in Ore Flotation

| Test No. | Collector, 0.15 lbs/ton | Float | Wt. % Recovery* Pb | Zn | Fe |
|---|---|---|---|---|---|
| 1 | None | Pb | 11.70 | 4.30 | 2.20 |
| | | Zn | 7.90 | 11.75 | 1.65 |
| | Average | | 19.60 | 16.05 | 3.85 |
| 2 | N—ethyl-S—isopropylsulfenyl dithiocarbamate | Pb | 45.70 | 9.40 | 3.33 |
| | | Zn | 15.93 | 71.33 | 9.16 |
| | Average | | 61.63 | 80.73 | 12.49 |
| 3 | O—isopropyl N—ethyl thionocarbamate | Pb | 52.07 | 13.60 | 5.47 |
| | | Zn | 12.63 | 64.70 | 9.60 |
| | Average | | 64.70 | 78.30 | 15.07 |

*The values shown for the first test represent average weight percent recoveries based on two runs. The values shown for the second and third tests represent average weight percent recoveries based on three runs.

The results of the tests show that the N-ethyl-S-isoproplysulfenyl dithiocarbamate, a sulfenyl dithiocarbamate used in the process of the present invention, is an effective collector for zinc in froth flotation processes. The addition of N-ethyl-S-isopropylsulfenyl dithiocarbamate to the ball mill significantly increased the amount of zinc present in the froth produced during the zinc float while depressing the amount of lead present in the froth. The sulfenyl dithiocarbamate led to a higher average weight percentage recovery of zinc than the O-isopropyl N-ethyl thionocarbamate, the other collector tested.

Thus, the examples show that the sulfenyl dithiocarbamates used in the process of the present invention are useful as mineral flotation agents in ore flotation processes. The examples reveal that the sulfenyl dithiocarbamates are particularly effective as collectors for copper, nickel, iron and zinc.

The preceeding examples can be repeated with similar success by substituting the generically or specifically described reactants and/or operating conditions of this invention for those used in the example. From the foregoing description, one skilled in the art can easily ascertain the essential characteristics of the invention, and without departing from the scope and spirit thereof, can make various changes and modifications of the invention to adapt it to various usages and conditions.

What is claimed is:

1. In a process for the recovery of minerals from an ore or concentrate containing the minerals wherein the ore or concentrate in the form of an aqueous pulp is subjected to froth flotation and the minerals are selectively recovered in the froth, and wherein a mineral flotation agent is employed in the aqueous pulp in an amount sufficient to control the type of minerals in the froth, the improvement comprising employing as said mineral flotation agent at least one sulfenyl dithiocarbamate defined by the formula:

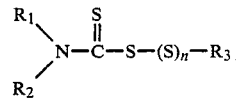

wherein:

$R_1$ and $R_2$ are each selected from the group consisting of hydrogen and hydrocarbyl groups with not more than one of $R_1$ and $R_2$ being hydrogen;

n is 1 or 2; and $R_3$ is a hydrocarbyl group.

2. The improvement of claim 1 wherein $R_1$ and $R_2$ are each selected from the group consisting of hydrogen and alkyl, alkenyl, cycloalkyl, and cycloalkenyl radicals, and combinations of alkyl, alkenyl, cycloalkyl or cycloalkenyl radicals with aryl radicals wherein the alkyl, alkenyl, cycloalkyl or cycloalkenyl group of the combination is attached to the nitrogen atom, with not more than one of $R_1$ and $R_2$ being hydrogen.

3. The improvement of claim 1 wherein $R_1$ and $R_2$ are each selected from the group consisting of hydrogen and alkyl, alkenyl, cycloalkyl and cycloalkenyl radicals having from 1 to 12 carbon atoms with only one of $R_1$ and $R_2$ being hydrogen, and n is 1.

4. The improvement of claim 1 wherein $R_1$ and $R_2$ are each selected from the group consisting of hydrogen and alkyl and alkenyl radicals having from 1 to 6 carbon atoms with only one of $R_1$ and $R_2$ being hydrogen, n is 1, and $R_3$ has from 1 to 8 carbon atoms.

5. The improvement of claim 1 wherein said sylfenyl dithiocarbamate is selected from the group consisting of N,N-dimethyl-S-isopropylsulfenyl dithiocarbamate and N-ethyl-S-isopropylsulfenyl dithiocarbamate.

6. The improvement of claim 1 wherein said sulfenyl dithiocarbamate is N-ethyl-S-isopropylsulfenyl dithiocarbamate.

7. The improvement of claim 1 wherein said sulfenyl dithiocarbamate is employed in an amount in the range of from about 0.005 pound to about 5 pounds per ton of solids in the pulp.

8. The improvement of claim 1 wherein said sulfenyl dithiocarbamate is employed in an amount in the range of from about 0.01 pound to about 0.5 pound per ton of solids in the pulp.

9. In a process for the recovery of minerals from an ore or concentrate containing the minerals wherein the ore or concentrate in the form of aqueous pulp is subjected to froth flotation and the minerals are selectively recovered in the froth, and wherein a mineral flotation collector is employed in the aqueous pulp in an amount sufficient to increase the amount of at least one of copper, nickle, iron or zinc in the froth, the improvement comprising employing as said mineral flotation collector at least one sulfenyl dithiocarbamate defined by the formula:

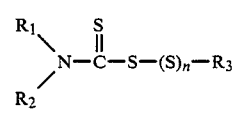

wherein:

$R_1$ and $R_2$ are each selected from the group consisting of hydrogen and hydrocarbyl groups with not more than one of $R_1$ and $R_2$ being hydrogen;

n is 1 or 2; and $R_3$ is a hydrocarbyl group.

10. The iprovement of claim 9 wherein $R_1$ and $R_2$ are each selected from the group consisting of hydrogen and alkyl, alkenyl, cycloalkyl, and cycloalkenyl radicals, and combinations of alkyl, alkenyl, cycloalkyl or cycloalkenyl radicals with aryl radicals wherein the alkyl, alkenyl, cycloalkyl or cycloalkenyl group of the combination is attached to the nitrogen atom, with not more than one of $R_1$ and $R_2$ being hydrogen.

11. The improvement of claim 9 wherein $R_1$ and $R_2$ are each selected from the group consisting of hydrogen and alkyl, alkenyl, cycloalkyl and cycloalkenyl radicals having from 1 to 12 carbon atoms with only one of $R_1$ and $R_2$ being hydrogen, and n is 1.

12. The improvement of claim 9 wherein $R_1$ and $R_2$ are each selected from the group consisting of hydrogen and alkyl and alkenyl radicals having from 1 to 6 carbon atoms with only one of $R_1$ and $R_2$ being hydrogen, n is 1, and $R_3$ has from 1 to 8 carbon atoms.

13. The improvement of claim 9 wherein said sulfenyl dithiocarbamate is selected from the group consisting of N,N-dimethyl-S-isopropylsulfenyl dithiocarbamate and N-ethyl-S-isopropylsulfenyl dithiocarbamate.

14. The improvement of claim 9 wherein said sulfenyl dithiocarbamate is N-ethyl-S-iopropylsulfenyl dithiocarbamate.

15. The improvement of claim 9 wherein said sulfenyl dithiocarbamate is employed in an amount in the range of from about 0.005 pound to about 5 pounds perton of solids in the pulp.

16. The improvement of claim 9 wherein said sulfenyl dithiocarbamate is employed in an amount in the range of from about 0.01 pound to about 0.5 pound per ton of solids in the pulp.

17. A process for recovering minerals comprising:

(a) mixing crushed ore containing minerals water, and a mineral flotation agent to establish a pulp and aerating the thus established pulp to produce a froth containing said minerals, said mineral flotation agent being employed in an amount sufficient to control the type of minerals in the froth and comprising a sulfenyl dithiocarbamate defined by the formula:

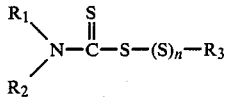

wherein:

$R_1$ and $R_2$ are each selected from the group consisting of hydrogen and hydrocarbyl groups with not more than one of $R_1$ and $R_2$ being hydrogen;

n is 1 or 2; and $R_3$ is a hydrocarbyl group; and (b) recovering the minerals from the froth.

18. The process of claim 17 wherein $R_1$ and $R_2$ are each selected from the group consisting of hydrogen and alkyl, alkenyl, cycloalkyl, and cycloalkenyl radicals, and combinations of alkyl, alkenyl, cycloalkyl or cycloalkenyl radicals with aryl radicals wherein the alkyl, alkenyl, cycloalkyl or cycloalkenyl group of the combination is attached to the nitrogen atom, with not more than one of $R_1$ and $R_2$ being hydrogen.

19. The process of claim 17 wherein $R_1$ and $R_2$ are each selected from the group consisting of hydrogen and alkyl, alkenyl, cycloalkyl and cycloalkenyl radicals having from 1 to 12 carbon atoms with only one of $R_1$ and $R_2$ being hydrogen, and n is 1.

20. The process of claim 17 wherein $R_1$ and $R_2$ are selected from the group consisting of hydrogen and alkyl and alkenyl radicals having from 1 to 6 carbon atoms with only one of $R_1$ and $R_2$ being hydrogen, n is 1, and $R_3$ has from 1 to 8 carbon atoms.

21. The process of claim 17 wherein said sulfenyl dithiocarbamate is selected from the group consisting of N,N-diemthyl-S-isopropylsulfenyl dithiocarbamate and N-ethyl-S-isopropylsulfenyl dithiocarbamate.

22. The process of claim 17 wherein said sulfenyl dithiocarbamate is N-ethyl-S-isopropylsulfenyl dithiocarbamate.

23. The process of claim 17 wherein said sulfenyl dithiocarbamate is employed in an amount in the range of from about 0.005 pound to about 5 pounds per ton of solids in the pulp.

24. The process of claim 17 wherein said sulfenyl dithiocarbamate is employed in an amount in the range of from about 0.01 pound to about 0.5 pound per ton of solids in the pulp.

25. The process of claim 17 wherein said minerals contained by said crushed ore comprise at least one of copper, nickle, iron and zinc, and wherein said sulfenyl dithiocarbamate is a mineral flotation collector and is employed to increase the amount of at least one of copper, nickle, iron and zinc in the froth.

* * * * *

UNITED STATES PATENT AND TRADEMARK OFFICE

CERTIFICATE OF CORRECTION

PATENT NO. : 4,883,585

DATED : November 28, 1989

INVENTOR(S) : Clarence R. Bresson and Rector P. Louthan

It is certified that error appears in the above-identified patent and that said Letters Patent is hereby corrected as shown below:

Column 5, line 55, delete the word "dired" and substitute the word --dried-- therefor;

Column 6, line 64, delete the word "pecent" and substitute the word --percent-- therefor;

Column 9, claim 10, line 1, delete the word "iprovement" and substitute the word --improvement-- therefor;

Column 9, claim 15, line 3, delete the word "perton" and substitute the words --per ton-- therefor;

Column 9, claim 17, line 2, insert a comma between the word "minerals" and the word "water"; and Column 10, claim 21, line 3, delete the word "N,N-diemthyl-S-isopropylsulfenyl" and substitute the word --N,N-dimethyl-S-isopropylsulfenyl-- therefor.

Signed and Sealed this

Sixteenth Day of October, 1990

*Attest:*

HARRY F. MANBECK, JR.

*Attesting Officer*

*Commissioner of Patents and Trademarks*